US009897043B2

(12) United States Patent
Nakagawa

(10) Patent No.: US 9,897,043 B2
(45) Date of Patent: Feb. 20, 2018

(54) AIR PUMP, MODULE, AND EVAPORATED FUEL PROCESSING SYSTEM

(71) Applicant: MITSUBISHI ELECTRIC CORPORATION, Tokyo (JP)

(72) Inventor: Satoshi Nakagawa, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 15/129,090

(22) PCT Filed: Apr. 21, 2014

(86) PCT No.: PCT/JP2014/061178

§ 371 (c)(1),
(2) Date: Sep. 26, 2016

(87) PCT Pub. No.: WO2015/162668

PCT Pub. Date: Oct. 29, 2015

(65) Prior Publication Data

US 2017/0107951 A1 Apr. 20, 2017

(51) Int. Cl.
*F02M 25/08* (2006.01)

(52) U.S. Cl.
CPC .... *F02M 25/0818* (2013.01); *F02M 25/0836* (2013.01)

(58) Field of Classification Search
CPC ..... F02M 25/08; F02M 25/0827; F02M 25/0818; F02M 25/0836; F02M 25/0809
See application file for complete search history.

(56) References Cited

U.S. PATENT DOCUMENTS

| | | | | |
|---|---|---|---|---|
| 5,450,834 A * | 9/1995 | Yamanaka | F02M 25/0809 123/198 D |
| 7,255,093 B2 * | 8/2007 | Iihoshi | F02M 25/0809 123/518 |
| 9,599,071 B2 * | 3/2017 | Dudar | F02M 25/0827 |
| 2008/0230307 A1 | 9/2008 | Matsumoto et al. | |
| 2012/0132179 A1 | 5/2012 | Kobayashi et al. | |

FOREIGN PATENT DOCUMENTS

| | | | |
|---|---|---|---|
| JP | 5-033626 A | 2/1993 | |
| JP | 2004156468 A * | 6/2004 | F02M 25/08 |
| JP | 2005-069103 A | 3/2005 | |
| JP | 2005-171947 A | 6/2005 | |
| JP | 2007-078322 A | 3/2007 | |
| JP | 2008-064042 A | 3/2008 | |
| JP | 2008-232053 A | 10/2008 | |
| JP | 2012-117381 A | 6/2012 | |
| WO | WO 2013/018142 A1 | 2/2013 | |

OTHER PUBLICATIONS

Osamu Mochizuki, Yoshiyuki Maruta, "Ryutaionkougaku Nyumon (Introduction of Fluid Sound Engineering)", Asakura Publishing Co., Ltd., Apr. 30, 1996, pp. 154-155.

* cited by examiner

*Primary Examiner* — Hieu T Vo
(74) *Attorney, Agent, or Firm* — Birch, Stewart, Kolasch & Birch, LLP

(57) ABSTRACT

A space $R_1$ is formed on a downstream side of a check valve 121 by providing a partition plate 139 having a hole 138 in an exhaust opening portion 137 provided in a third housing 132 of an air pump 12 to separate the third housing 132 from the outside. A noise generated from the check valve 121 of the air pump 12 is reduced in the space $R_1$.

6 Claims, 7 Drawing Sheets

AIR PUMP, MODULE, AND EVAPORATED FUEL PROCESSING SYSTEM

TECHNICAL FIELD

The present invention relates to an air pump used for diagnosing a leak by utilizing a pressure fluctuation of automobile piping, a module configured by the air pump, and an evaporated fuel processing system that uses the air pump.

BACKGROUND ART

For the purpose of preventing air pollution, an evaporation system (evaporated fuel processing system) for processing evaporated gas is mounted to an automobile to prevent the evaporated gas (evaporated fuel) generated in a fuel tank from being released into the atmosphere.

In North America, it is further prescribed by law to check whether or not an abnormality such as breakage, a crack, or a hole is present in piping itself of the evaporation system at a specific frequency. Accordingly, it is necessary to perform a leak diagnosis with the piping of the evaporation system and the following method is generally used: a pressure is applied to the piping of the evaporation system in a sealed state, and a fluctuation of the pressure is monitored.

The method in which the pressure is applied to the piping of the evaporation system during the leak diagnosis differs depending on an automobile manufacturer, and the method includes a method that uses an air pump and a method that uses a pressure fluctuation caused by natural heat radiation.

While the leak diagnosis in the case of using the natural heat radiation is capable of performing the diagnosis without generating a noise, there are disadvantages that a long diagnosis time increases total power consumption and also that a sufficient diagnosis frequency cannot be secured.

On the other hand, the leak diagnosis in the case of using the air pump can be carried out in a short time period to thereby achieve power saving and secure the sufficient diagnosis frequency. However, as described about a configuration for absorbing an operation sound of a leak diagnosis apparatus in Patent Document 1, and a configuration for alleviating a collision inside a leak diagnosis apparatus in Patent Document 2, there occurs a problem that a noise is generated during the diagnosis. Since the leak diagnosis in the case of using the air pump is performed under a quiet condition during stop of an engine, the noise during the diagnosis, in particular, poses a problem as an abnormal noise.

Note that Non-Patent Document 1 describes a general sound absorbing structure that absorbs sound, but is not limited to the noise generated during the leak diagnosis.

CITATION LIST

Patent Documents

Patent Document 1: Japanese Patent Application Laid-open No. 2012-117381

Patent Document 2: Japanese Patent Application Laid-open No. 2005-69103

Non-Patent Documents

Non-Patent Document 1: Osamu Mochizuki, Yoshiyuki Maruta "Ryutaionkougaku Nyumon (Introduction of Fluid Sound Engineering)" Asakura Publishing Co., Ltd., Apr. 30, 1996, p. 154-155

SUMMARY OF THE INVENTION

Problems to be Solved by the Invention

As described above, the leak diagnosis in the case of using the air pump has the problem of the noise generation during the diagnosis, and there exist various noise generation sources. For example, a check valve provided in the air pump also is one of the generation sources, and a vibration of the check valve during operation of the air pump generates the noise.

The present invention has been made in order to solve the above problem, and an object thereof is to reduce the noise generated from the check valve of the air pump during the leak diagnosis.

Means for Solving the Problems

An air pump according to the invention changes, for a leak diagnosis, an internal pressure of an evaporated fuel processing system that collects evaporated fuel generated in a fuel tank to introduce the collected evaporated fuel into an engine, and includes: a housing provided with an opening portion communicating with the evaporated fuel processing system and an opening portion communicating with an air side; a check valve disposed between the two opening portions of the housing to prevent a backflow of discharged gas; and a partition plate in which a hole serving as a first reducing part is opened and which is disposed at the opening portion from which the gas is discharged out of the two opening portions of the housing, to separate an inside from an outside of the housing, wherein a pipe in which a hole is formed is protrusively provided in the partition plate, and the pipe is extended toward the check valve to constitute a second reducing part with the pipe and the check valve.

A module according to the invention includes: an electromagnetic valve that opens and closes a flow path connecting an air side and an evaporated fuel processing system that collects evaporated fuel generated in a fuel tank to introduce the collected evaporated fuel into an engine; an air pump that changes an internal pressure of the evaporated fuel processing system for a leak diagnosis; and a case that contains the electromagnetic valve and the air pump, wherein the air pump has a housing provided with an opening portion communicating with the evaporated fuel processing system and an opening portion communicating with the air side, and a check valve disposed between the two opening portions of the housing to prevent a backflow of discharged gas, and one surface of the case is a partition plate in which a hole serving as a first reducing part is opened and which faces the opening portion from which the gas is discharged out of the two opening portions provided in the housing of the air pump, to separate an inside from an outside of the housing, wherein a pipe in which a hole is formed is protrusively provided in the partition plate, and the pipe is extended toward the check valve to constitute a second reducing part with the pipe and the check valve.

An evaporated fuel processing system according to the invention collects evaporated fuel generated in a fuel tank to introduce the collected evaporated fuel into an engine, and includes: an air pump that changes an internal pressure of the evaporated fuel processing system for a leak diagnosis; and an insertion opening into which the air pump is inserted, wherein the air pump has a housing provided with an opening portion communicating with the inside of the evaporated fuel processing system and an opening portion communicating with an air side, and a check valve disposed between the two opening portions of the housing to prevent a backflow of discharged gas, and the insertion opening has a partition plate in which a hole serving as a first reducing part is opened and which faces the opening portion from which the gas is discharged out of the two opening portions provided in the housing of the air pump, to separate an inside from an outside of the housing, wherein a pipe in which a hole is formed is protrusively provided in the partition plate, and the pipe is extended toward the check valve to constitute a second reducing part with the pipe and the check valve.

Effect of the Invention

According to the invention, the partition plate is adapted to separate the inside from outside of the housing on the side of the opening portion from which the gas is discharged out of the opening portions provided in the housing of the air pump, to thereby form a space for sound reduction on a downstream side of the check valve, and hence it is possible to reduce noise generated from the check valve of the air pump during the leak diagnosis.

MODES FOR CARRYING OUT THE INVENTION

Hereinbelow, in order to describe the invention in greater detail, the best mode for carrying out the invention will be described according to the accompanying drawings.

Embodiment 1

Figure 1:
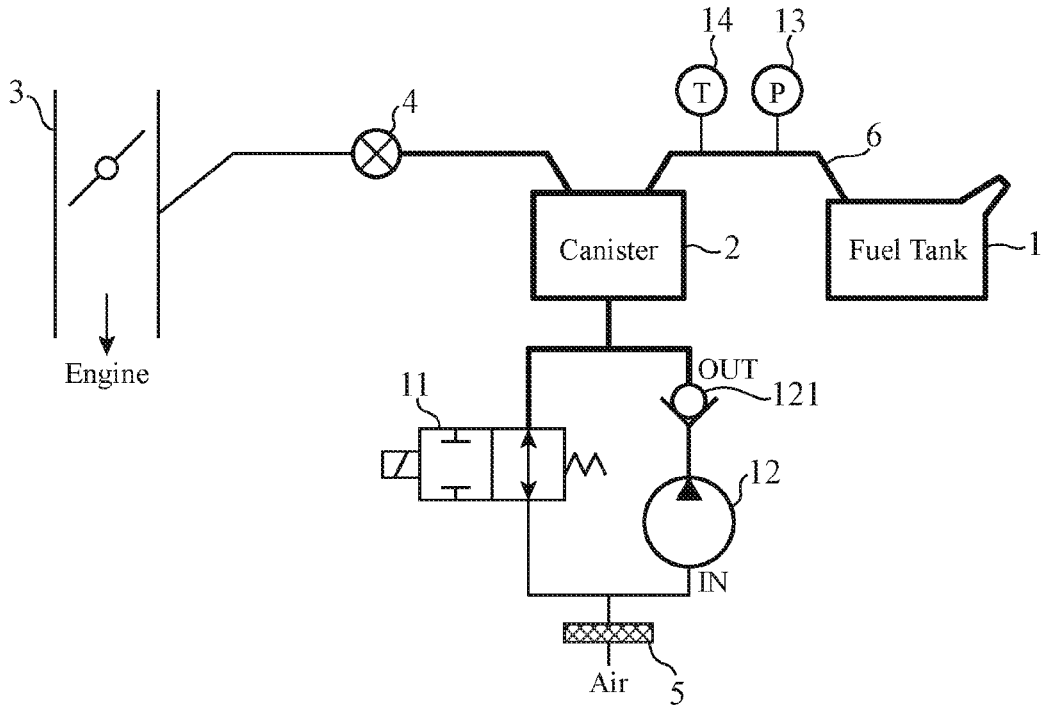
FIG. 1 is a view showing a configuration of an air pump according to Embodiment 1 of the invention, a leak diagnosis apparatus that includes the air pump, and an evaporation system that serves as a diagnosis target by the leak diagnosis apparatus.

An evaporation system shown in FIG. 1 is configured by a fuel tank 1, a canister 2 that absorbs and temporarily stores evaporated gas generated in the fuel tank 1, an inlet manifold 3 that introduces the evaporated gas collected by the canister 2 into an engine, a purge solenoid valve 4 that controls the amount of the evaporated gas, a filter 5 that removes dust from passing gas, and piping that connects them. In addition, a piping system 6 indicated by a thick line in FIG. 1 is a piping system to be a target of a leak diagnosis.

The leak diagnosis of the piping system 6 is performed by using a leak diagnosis apparatus that includes an electromagnetic valve 11 that opens and closes a pipe that provides communication between the piping system 6 and an air side, an air pump 12 that introduces the air into the piping system 6 from the air side to pressurize the inside of the piping system 6, a pressure gauge 13 that detects a pressure in the piping system 6, and a temperature gauge 14 that detects a temperature inside the piping system 6. In addition, a check valve 121 that prevents a backflow of compressed air discharged by the air pump 12 is provided between the air pump 12 and the piping system 6. In Embodiment 1, the air pump 12 and the check valve 121 are provided by an integrated structure.

Figure 2:
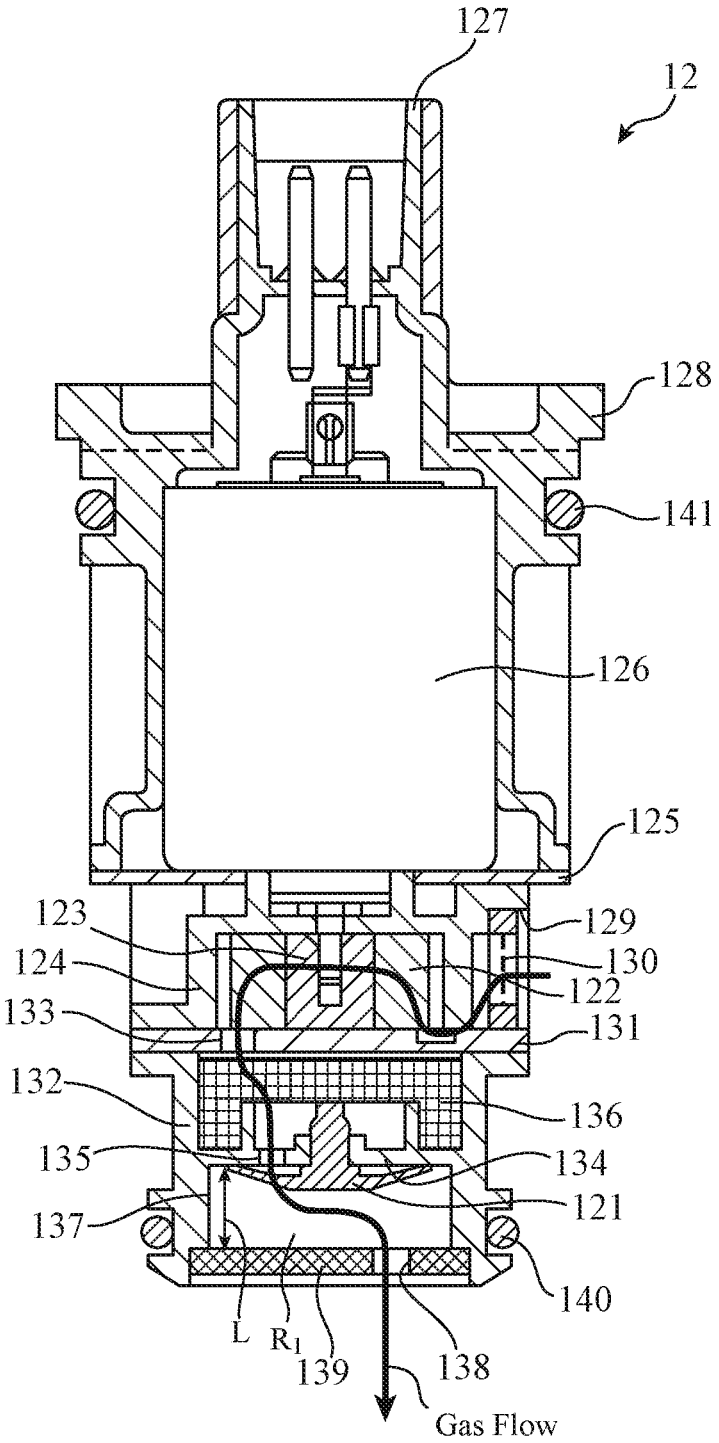
FIG. 2 is a cross-sectional view of the air pump according to Embodiment 1 of the invention.

FIG. 2 shows a cross-sectional view of the air pump 12.

In the air pump 12, a rotor 123 that rotates a plurality of vanes 122, a first housing 124 made of resin that accommodates the vanes 122 and the rotor 123, and a motor 126 that is fixed to the first housing 124 with a metal plate 125 interposed between the motor and the first housing 124 to rotationally drive the rotor 123 are provided. The motor 126 is contained in a case 128 having a connector 127. In addition, an intake opening portion 129 that communicates with the air side to take in the air is provided in the first housing 124, and a filter 130 is mounted to the intake opening portion.

A bottom surface side of the first housing 124 is covered with a second housing 131 which is a plate-like component made of resin, and a third housing 132 which is a cylindrical component made of resin is further mounted to the second housing. The second housing 131 and third housing 132 are fastened to the metal plate 125 together with the first housing 124 with screws not shown.

An opening portion 133 through which the air having entered from the intake opening portion 129 passes is provided in the second housing 131, and an opening portion 135 through which the air having entered from the opening portion 133 passes is provided in a partition wall 134 of the third housing 132. A sponge-like filter 136 is provided in a space formed between the second housing 131 and partition wall 134 of the third housing 132. In addition, an outer side of the partition wall 134, that is, a lower portion of the third housing 132, serves as an exhaust opening portion 137 that communicates with the piping system 6, and a partition plate 139 made of, e.g., resin that separates the inside from outside of the third housing 132 is provided in the exhaust opening portion 137. A hole 138 is formed in the partition plate 139, and the hole 138 allows passage of the air having entered from the opening portion 135.

A shaft end portion of the check valve 121 passes through and is engaged with the partition wall 134 of the third housing 132. In addition, an umbrella-shaped valve body of the check valve 121 is positioned in the exhaust opening portion 137, and receives the pressure of the air flowing in from the opening portion 133 by the operation of the motor 126 to open the opening portion 135, and closes the opening portion 135 when receiving the pressure from the piping system 6.

An O-ring 140 is provided on an outer peripheral surface of the third housing 132, and an O-ring 141 is provided on an outer peripheral surface of the case 128. When the air pump 12 is used by mounting it to a component other than the air pump 12 such as a pipe that connects the canister 2 and the air side, the O-rings are provided in order to seal such mounting portions to thereby prevent the air discharged to the side of the piping system 6 from the exhaust opening portion 137 from leaking from the mounting portions.

A description will be given of a flow during the leak diagnosis by the leak diagnosis apparatus having the air pump 12 configured as described above. The air pump 12 may be mounted to any position as long as the position allows pressurization of the inside of the piping system 6.

For example, the air pump 12 may be mounted to the fuel tank 1, the canister 2, the filter 5, or the pipe of the piping system 6 indicated by a thick line in FIG. 1. In this case, as shown in FIG. 1, the case where the air pump is mounted to the pipe of the piping system 6 will be described.

During the leak diagnosis, the air pump 12 is driven with the purge solenoid valve 4 and the electromagnetic valve 11 closed. In the air pump 12, the air is sucked from the air side to the intake opening portion 129 by the rotation of the vanes 122 caused by the rotation of the motor 126, and the air is discharged to the opening portion 133. When the air having passed through the opening portion 133 further passes through the filter 136, dust thereof is removed, and the air is discharged from the opening portion 135. Subsequently, the air is discharged from the hole 138 of the partition plate 139 provided in the exhaust opening portion 137 to the side of the canister 2, and the inside of the piping system 6 is pressurized. In this manner, the pressure in the piping system 6 is put in a state different from atmospheric pressure.

During driving of the air pump 12, the check valve 121 repeatedly opens and closes the opening portion 135 in a state in which a large pressure difference between front and back of the check valve 121 occurs, and hence a vibration of the check valve 121 caused by flow pulsation is increased, so that a noise is generated. At this point, a space $R_1$ separated from the outside of the third housing 132 by the partition plate 139 is formed on a downstream side of the check valve 121, and the noise generated by the vibration of the check valve 121 goes out from the hole 138 with the noise reduced in the space $R_1$. Consequently, the noise to be traveled to the outside of the air pump 12 is made smaller as compared with the case where the partition plate 139 is not provided.

A frequency $f_0$ (Hz) of the noise reduced at this point can be calculated by the following Expression (1) on the assumption that the space $R_1$ separated from the outside of the third housing 132 by the partition plate 139 to be formed on the downstream side of the check valve 121 is in the shape of a rectangular parallelepiped:

$$f_o = \frac{a}{4L} \tag{1}$$

In Expression (1), L (m) is the distance from the partition wall 134 to the partition plate 139, and a (m/s) is the velocity of sound. When the position of the partition plate 139, namely the distance L, is set such that the frequency $f_0$ matches the frequency exhibiting the peak of the noise generated by the vibration of the check valve 121, the noise can be reduced effectively.

In addition, when an opening area of the hole 138 of the partition plate 139 is set to a proper value, it is possible to generate a pressure difference between the inside and the outside of the third housing 132 with the partition plate 139 serving as the boundary. That is, it is possible to change stepwise the pressure in a path from the downstream side of the check valve 121 to the canister 2. An opening area S ($m^2$) of the hole 138 capable of generating the pressure difference can be calculated by the following Expression (2):

$$S \leq \frac{Q}{6 \times 10^4} \sqrt{\frac{\rho}{100}} \tag{2}$$

In Expression (2), Q is the flow rate (L/min) of the air discharged by the air pump 12, and ρ is the density ($kg/m^3$) of the air discharged by the air pump 12.

When the pressure in the path from the downstream side of the check valve 121 to the canister 2 is changed stepwise, the pressure difference between front and back of the check valve 121 can be reduced to thus suppress the vibration of the check valve 121 caused by the flow pulsation. As a result, the noise generated by the vibration can be made smaller.

For example, in the case where the generated noise is reduced by a sound absorbing member, the frequency having a sound reduction effect is limited. However, the sound reduction effect is equally obtained irrespective of the frequency when the vibration itself is suppressed with the partition plate 139. The sound quality of the noise generated by the vibration of the check valve 121 differs depending on, for example, dimensional variations of the check valve 121 and peripheral components of the check valve 121, an atmosphere temperature, and degradation over time, and hence, in light of such conditions, in addition to the configuration in which the sound reduction effect is exerted in the specific frequency by adjustment of L in Expression (1), the sound reduction effect is enhanced when the following configuration is adopted: the vibration itself is suppressed by adjustment of S in Expression (2), so that the sound reduction effect is equallly obtained, irrespective of the frequency.

Figure 3:
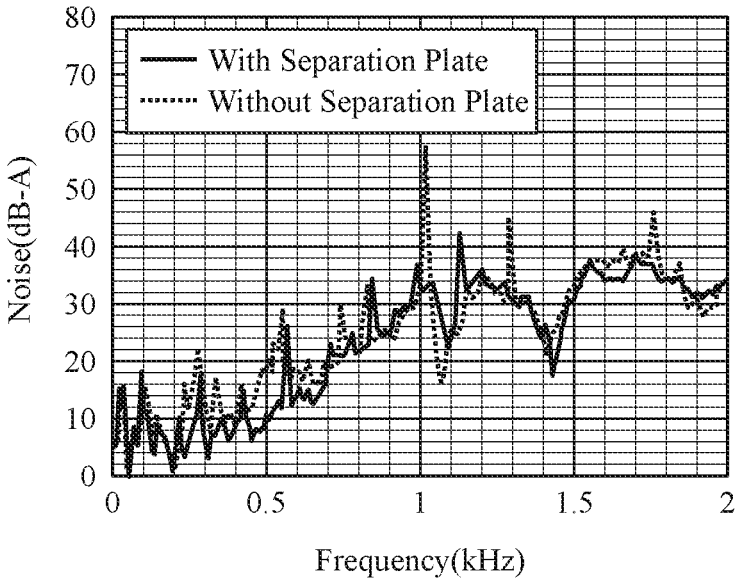
FIG. 3 is a view showing a sound reduction effect in Embodiment 1 of the invention.

FIG. 3 shows the sound reduction effect by the provision of the partition plate 139. A dotted line in FIG. 3 indicates a measurement result in the case where the partition plate 139 is not provided, while a solid line indicates a measurement result in the case where the partition plate 139 having the hole 138 of 2 mm in diamter is provided. It can be seen that the noise is further suppressed in the case where the partition plate 139 is provided and that, in particular, the peak appearing around 1 kHz is suppressed.

In the leak diagnosis, the pressure inside the piping system 6 is monitored by the pressure gauge 13, and the operation of the air pump 12 is stopped at a point of time when a pressure difference between the pressure and atmospheric pressure is generated up to a state that allows the leak diagnosis. At this point, since the pressure on the side of the exhaust opening portion 137 that communicates with the piping system 6 is higher than the pressure on the side of the space in which the filter 136 is disposed, the check valve 121 closes the opening portion 135 due to the pressure difference and completely seals the piping system 6 to thereby maintain a high-pressure state. A pressure fluctuation in the piping system 6 in the completely sealed state is compared with that serving as a reference in the case where a leak occurs, and it is thereby possible to diagnose presence or absence of the leak occurrence. The pressure fluctuation serving as the reference in the case where the leak occurs is corrected by a pipe volume of the piping system 6, a fuel amount in the fuel tank 1, the temperature monitored by the temperature gauge 14, and so on.

As mentioned above, when the partition plate 139 having the hole 138 is provided in the exhaust opening portion 137 to separate the inside from outside of the third housing 132, it is possible to reduce the noise generated due to the vibration of the check valve 121 caused by the flow pulsation.

In addition, when the opening area of the hole 138 provided in the partition plate 139 is set to the proper value, the vibration of the check valve 121 caused by the flow pulsation can be suppressed to thus reduce the noise generated due to the vibration of the check valve 121.

Further, the provision of the partition plate 139 can prevent the dust from the piping system 6 from adhering to the check valve 121.

Furthermore, it is only necessary to provide the partition plate 139, and hence a noise countermeasure can be implemented inexpensively.

Figure 4:
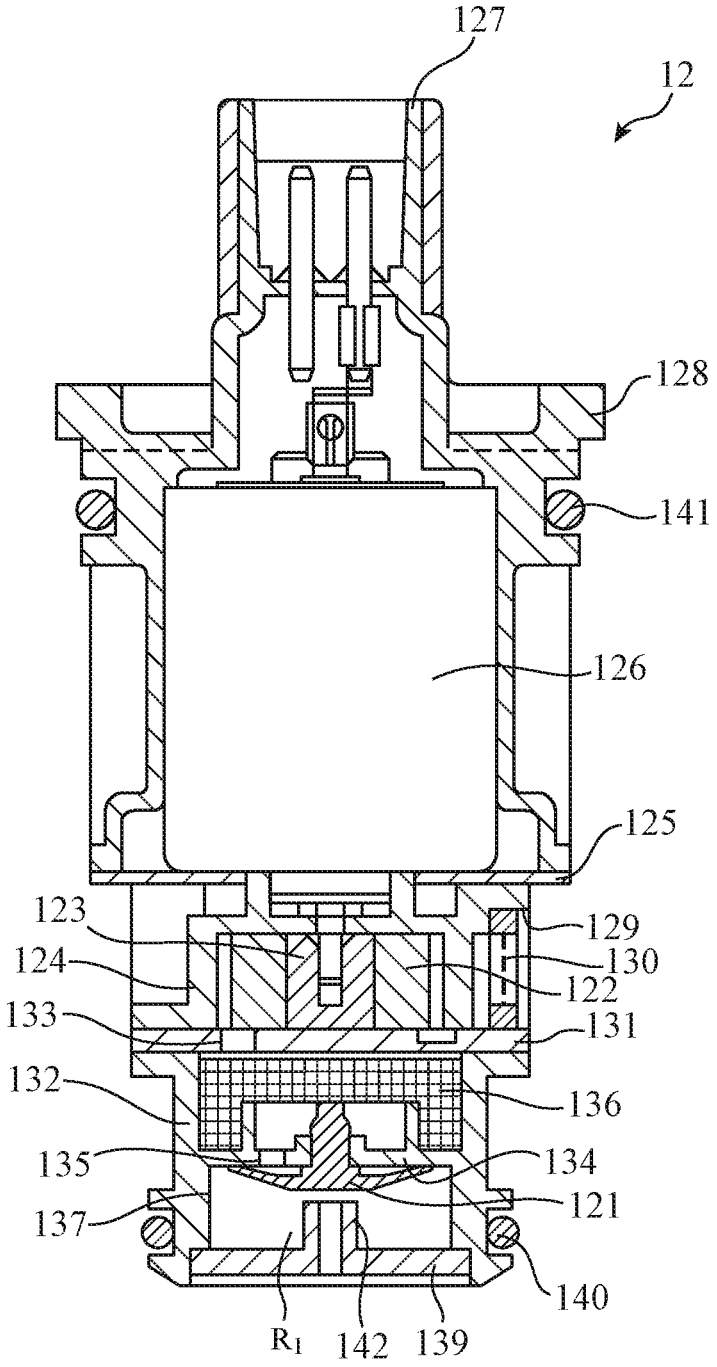
FIG. 4 is a cross-sectional view showing a modification of the air pump according to Embodiment 1 of the invention.
Figure 5A:
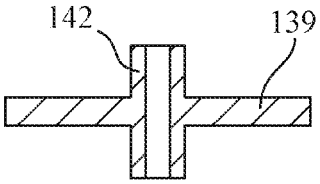
FIGS. 5(*a*) to 5(*d*) have plan views and cross-sectional views showing modifications of a partition plate in Embodiment 1 of the invention.
Figure 5C:
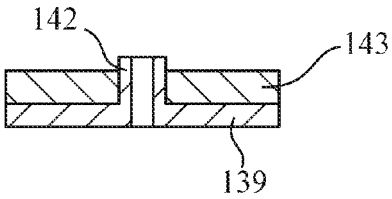
Figure 5B:
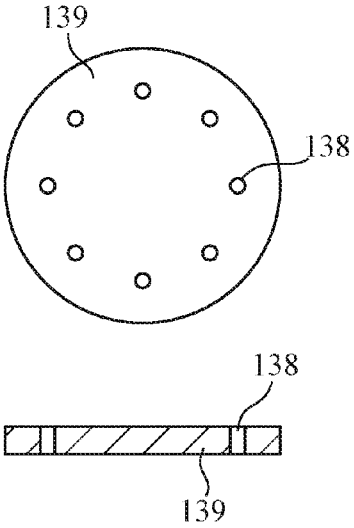
Figure 5D:
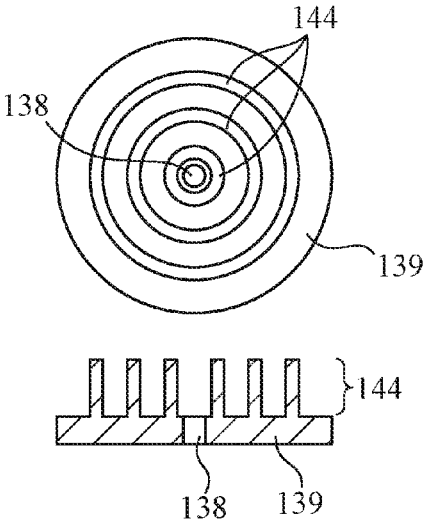

Note that, though the configuration in which the hole 138 is provided in the partition plate 139 has been described, as shown in FIG. 4, a pipe 142 may also be provided. With this arrangement, it is possible to enhance the sound reduction effect to a level higher than that in the case where the hole 138 is simply provided. In the case where the pipe 142 is provided, the pipe 142 may be protruded to the inner side of the air pump 12, or may also be protruded to the outer side of the air pump 12. Alternatively, as shown in a cross-sectional view in FIG. 5(*a*), the pipe may also be protruded to both of the inner and outer sides of the air pump 12. However, when the length of the portion protruding to the outer side of the air pump 12 is too long, the size of the entire air pump 12 is increased in an axial direction, and hence the pipe 142 is preferably protruded to the inner side of the air pump 12 to such an extent that the opening and closing operations of the check valve 121 are not inhibited.

In addition, as shown in a plan view and a cross-sectional view in FIG. 5(*b*), a plurality of the holes 138 may also be provided in the partition plate 139. In this case, in order to generate the pressure difference between the inside and outside of the third housing 132 with the partition plate 139 serving as the boundary, a total opening area of the plurality of the holes 138 is set to satisfy the opening area S of Expression (2). As the number of the holes 138 is increased and the opening area of each of the holes 138 is reduced, the dust from the piping system 6 becomes less likely to adhere to the check valve 121.

Further, as shown in a cross-sectional view in FIG. 5(*c*), a sound absorbing member 143 may be provided on a surface of the partition plate 139 on the inner side of the air pump 12. With this arrangement, it is possible to enhance the sound reduction effect to a level higher than that in the case lacking the sound absorbing member 143.

Furthermore, as shown in a plan view and a cross-sectional view in FIG. 5(*d*), ribs 144 that circularly protrude from the surface of the partition plate 139 on the inner side of the air pump 12 may be provided. With this arrangement, it is possible to enhance the sound reduction effect to a level higher than that in the case lacking the ribs 144.

In the partition plate 139, the position, size, and shape, and the number of the hole 138, pipe 142, and rib 144 are not limited to those shown in FIGS. 2, 4, and 5.

In addition, as the following configuration is shown in FIG. 5(*c*): the pipe 142 is provided in the partition plate 139, and the sound absorbing member 143 is further provided thereto, individual configurations of the provision of the hole 138, the provision of the pipe 142, the provision of the plurality of the holes 138, the provision of the sound absorbing member 143, the provision of the ribs 144, and so on may be combined with each other.

Further, in each of the configurations shown in FIG. 5, a specific frequency at which an especially high sound reduction effect of the noise is obtained is present. When the configuration of the partition plate 139 is set such that the frequency exhibiting the peak of the noise generated by the vibration of the check valve 121 matches the specific frequency, the noise can be reduced effectively.

As described above, according to Embodiment 1, the partition plate 139 having the hole 138 is provided in the exhaust opening portion 137 provided in the third housing 132 of the air pump 12 to separate the inside from outside of the third housing 132, so that the space $R_1$ is formed on the downstream side of the check valve 121. Since the noise generated by the vibration of the check valve 121 is reduced in the space $R_1$, it is possible to reduce the noise generated from the check valve 121 of the air pump 12 during the leak diagnosis.

In addition, it is adapted that the hole 138 of the partition plate 139 has the opening area that generates the pressure difference between the inside and outside of the third housing 132 with the partition plate 139 serving as the boundary. Consequently, the pressure is changed stepwise in the path that passes through the piping system 6 from the downstream side of the check valve 121, whereby the pressure difference between front and back of the check valve 121 can be reduced to thereby suppress the vibration of the check valve 121 caused by the flow pulsation. As a result, the noise generated by the vibration can be diminished.

Further, it is adapted that the plurality of the holes 138 are formed in the partition plate 139. Consequently, when the opening area of each of the holes 138 is made smaller, it is possible to further make the dust from the piping system 6 less likely to adhere to the check valve 121.

Furthermore, it is adapted that the pipe 142 is protrusively provided in the partition plate 139. Consequently, it is possible to further enhance the sound reduction effect to the noise generated by the vibration of the check valve 121.

Additionally, it is adapted that the ribs 144 are protrusively provided on the surface of the partition plate 139 that faces the check valve 121. Consequently, it is possible to further enhance the sound reduction effect to the noise generated by the vibration of the check valve 121.

In addition, it is adapted that the sound absorbing member 143 is provided on the surface of the partition plate 139 that faces the check valve 121. Consequently, it is possible to further enhance the sound reduction effect to the noise generated by the vibration of the check valve 121.

Embodiment 2

Though in Embodiment 1, the case where the leak diagnosis is performed with the air pump 12 singly mounted to another component such as the pipe has been described, the air pump 12 may also be mounted with integrated with the electromagnetic valve 11.

Figure 6A:
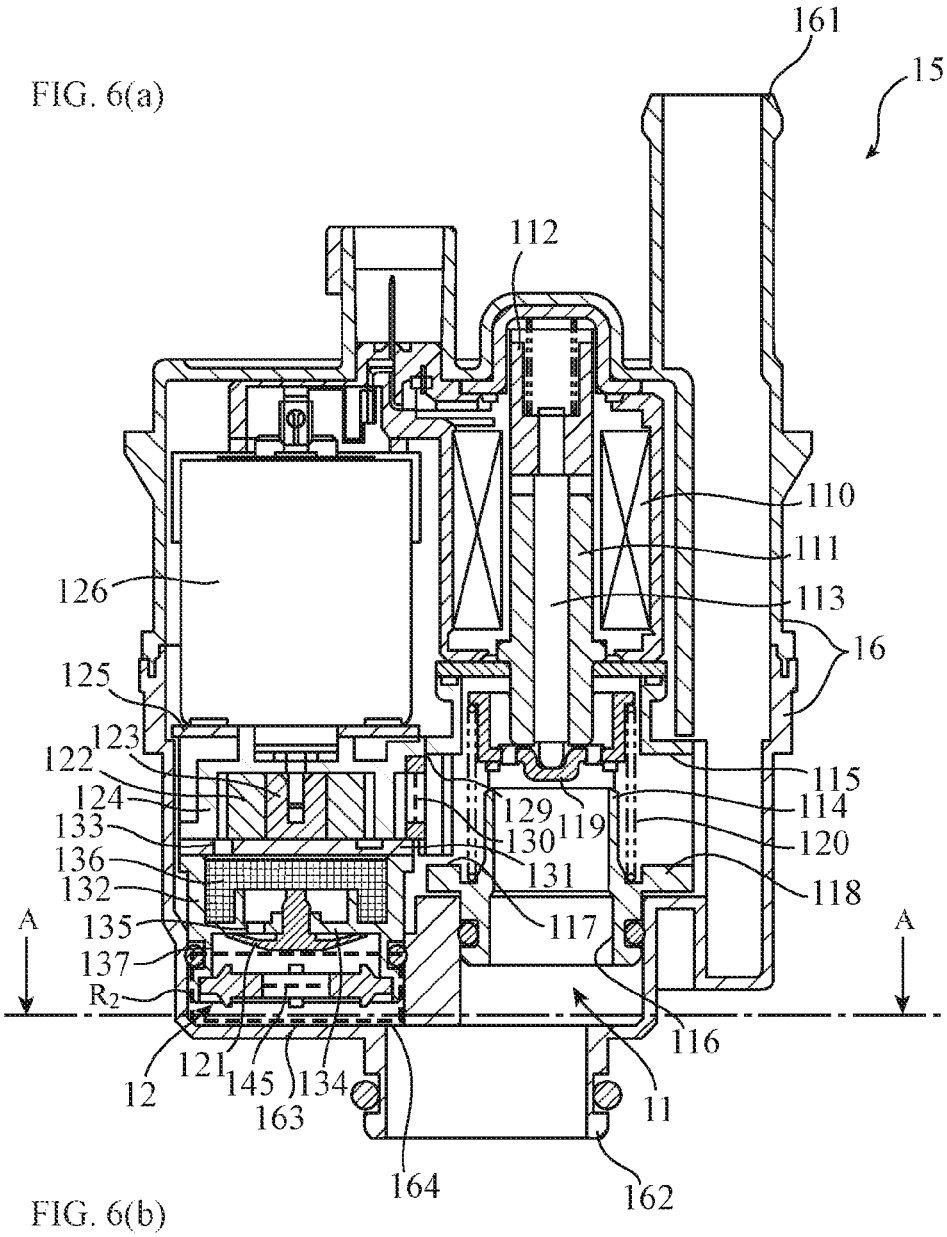
FIGS. 6(*a*) and 6(*b*) are a cross-sectional view when an air pump and an electromagnetic valve are integrated into a module in Embodiment 2 of the invention.
Figure 6B:
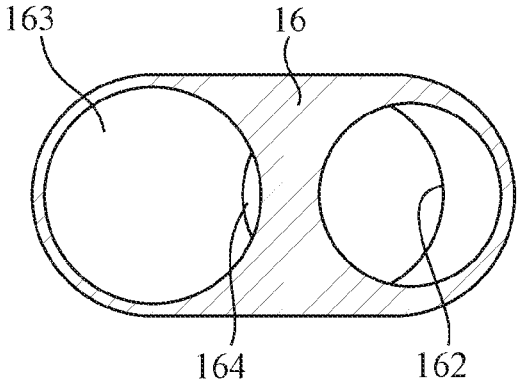

FIG. 6(*a*) shows a module 15 in which the electromagnetic valve 11 and air pump 12 are integrated with each other. The module 15 contains the electromagnetic valve 11 and air pump 12 in a case 16, and the case 16 has a first port 161 that communicates with an air side, and a second port 162 that communicates with the piping system 6.

The electromagnetic valve 11 has a core 111 that is excited when a coil 110 is energized, a plunger 112 that can reciprocate by magnetic attraction of the core 111, and a rod 113 that is supported in the core 111 and interlocked with the plunger 112. In addition, in a housing 118 of the electromagnetic valve 11, a valve seat 114, a first opening portion 115 that communicates with the first port 161 of the case 16, a second opening portion 116 that communicates with the second port 162 of the case 16, and a third opening portion 117 that communicates with an intake opening portion 129 of the air pump 12 are formed. Further, inside the housing 118, a valve body 119 that is fixed to an end of the rod 113, a spring 120 that constantly biases the valve body 119 in a valve opening direction, and the like are disposed.

FIG. 6(*a*) shows a non-energization state, that is, a valve opened state in which communication between the first opening portion 115 and second opening portion 116 is established.

At the time of excitation, the valve body 119 moves to the side of the valve seat 114 to establish a valve closed state, and the first opening portion 115 and second opening portion 116 of the housing 118 are blocked from each other. Note that, even when the electromagnetic valve 11 is closed, communication between the first opening portion 115 and third opening portion 117 is established via a space in which the spring 120 is prepared.

The air pump 12 is contained in the case 16 when the case 128 shown in FIG. 2 is removed. In addition, in the exhaust opening portion 137, a filter 145 is provided instead of the partition plate 139 shown in FIG. 2. Note that since it is possible to prevent the dust from the piping system 6 from adhering to the check valve 121 with a wall (partition plate) 163 described later, the filter 145 may be omitted. With regard to the air pump 12 in FIG. 6(*a*), parts identical or equivalent to those in FIG. 2 are designated by the same reference numerals, and descriptions thereof will be omitted or simplified.

FIG. 6(*b*) is a cross-sectional view taken along a line A-A of FIG. 6(*a*). In the wall 163 of the case 16 that faces the exhaust opening portion 137 of the air pump 12, a hole 164 that communicates with the second port 162 is formed.

A description will be given of a flow during a leak diagnosis by a leak diagnosis apparatus having the module 15 configured as described above. Similarly to the description in Embodiment 1, the module 15 may be mounted to any position as long as the air pump 12 can pressurize the inside of the piping system 6.

During the leak diagnosis, while the electromagnetic valve 11 is closed and the first opening portion 115 and second opening portion 116 are blocked from each other, the air pump 12 sucks from the intake opening portion 129, the air having passed through the first port 161, the first opening portion 115, the space in which the spring 120 is provided, and the third opening portion 117.

The air sucked from the intake opening portion 129 passes through the filter 145 and the hole 164 provided in the wall 163 of the case 16 after passing through the air pump 12 and enters the second port 162, to pressurize the inside of the piping system 6. At this point, the wall 163 of the case 16 that faces the exhaust opening portion 137 and the hole 164 that is provided in the wall 163 correspond to the partition plate 139 and hole 138 in Embodiment 1, respectively. That is, similarly to the partition plate 139 and the hole 138, a space $R_2$ that is separated from the outside of the third housing 132 by the wall 163 is formed on the downstream side of the check valve 121, and the noise generated by the vibration of the check valve 121 is reduced in the space $R_2$.

As described above, according to Embodiment 2, the inside and outside of the third housing 132 of the air pump 12 are separated from each other with the wall 163 of the case 16 of the module 15 in which the electromagneitc valve 11 and air pump 12 are integrated with each other, so that the space $R_2$ is formed on the downstream side of the check valve 121. Since the noise generated by the vibration of the check valve 121 is reduced in the space $R_2$, similarly to Embodiment 1, it is possible to reduce the noise generated from the check valve 121 of the air pump 12 during the leak diagnosis.

In addition, in Embodiment 1, the noise countermeasure has been taken by additionally disposing the partition plate 139 that is the component for the noise countermeasure, but the noise countermeasure can be taken by utilizing the shape of the case 16 in Embodiment 2, and hence it is not necessary to additionally dispose the component for the noise countermeasure intentionally.

Embodiment 3

Embodiment 2 has described the case where the noise countermesure is taken by utilizing the shape of the case 16 when the electromagnetic valve 11 and air pump 12 are integrated into the module 15, and the noise countermeasure may be taken by utilizing the shape of another component such as a pipe when the air pump 12 is singly mounted to another component such as the pipe.

Figure 7:
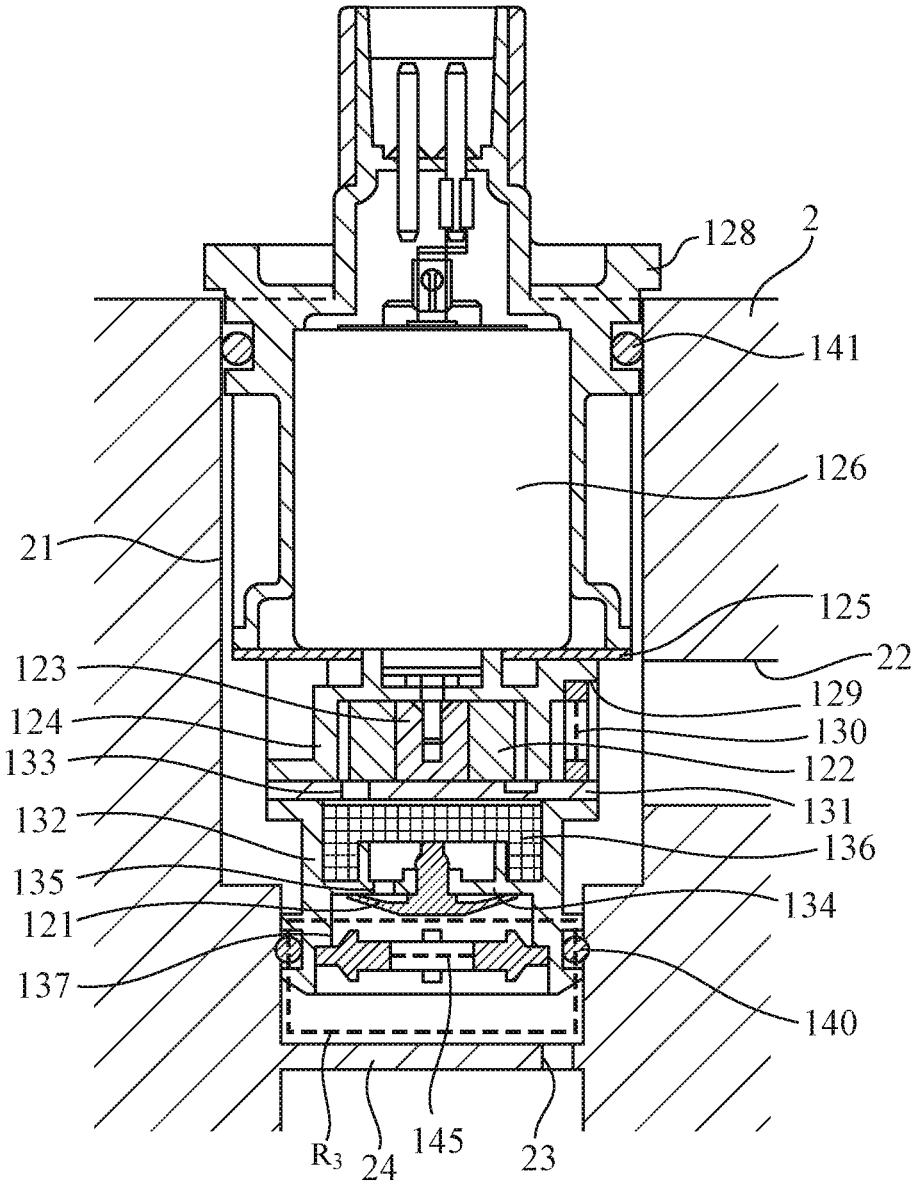
FIG. 7 is a cross-sectional view when an air pump is inserted into a canister in Embodiment 3 of the invention.

FIG. 7 shows a cross-sectional view when the air pump 12 is mounted to, e.g., the canister 2. The canister 2 has an insertion opening 21 for the air pump 12, an opening portion 22 that communicates with an air side is provided in a side surface of the insertion opening 21, and a partition wall (partition plate) 24 having a hole 23 is provided on a bottom surface of the insertion opening 21.

The intake opening portion 129 of the air pump 12 faces the opening portion 22 of the canister 2, and the exhaust opening portion 137 is covered with a filter 145 instead of the partition plate 139 shown in FIG. 2. Note that it is possible to prevent the dust from the piping system 6 from adhering to the check valve 121 with the partition wall 24, and hence the filter 145 may be omitted. With regard to the air pump 12 in FIG. 7, parts identical or equivalent to those in FIGS. 2 and 6 are designated by the same reference numerals, and descriptions thereof will be omitted or simplified.

During the leak diagnosis, the air pump 12 sucks the air having passed through the opening portion 22 of the canister 2 from the intake opening portion 129.

The air sucked from the intake opening portion 129 passes through the filter 145 and the hole 23 of the partition wall 24 after passing through the air pump 12 and enters the canister 2, to pressurize the inside of the piping system 6. At this point, the partition wall 24 that faces the exhaust opening portion 137 and the hole 23 that is provided in the partition wall 24 correspond to the partition plate 139 and the hole 138 in Embodiment 1, respectively. That is, similarly to the partition plate 139 and the hole 138, a space $R_3$ that is separated from the outside of the third housing 132 by the partition wall 24 is formed on the downstream side of the check valve 121, and the noise generated by the vibration of the check valve 121 is reduced in the space $R_3$.

As described above, according to Embodiment 3, the inside and outside of the third housing 132 of the air pump 12 are separated from each other with the partition wall 24 provided on the bottom surface of the insertion opening 21 prepared in the canister 2, so that the space $R_3$ is formed on the downstream side of the check valve 121. Since the noise generated by the vibration of the check valve 121 is reduced in the space $R_3$, similarly to Embodiment 1, it is possible to reduce the noise generated from the check valve 121 of the air pump 12 during the leak diagnosis.

The noise countermeasure has been taken by additionally disposing the partition plate 139 that is the component for the noise countermeasure in Embodiment 1, while in Embodiment 3, it is possible to mold the partition wall 24 and the hole 23 integrally when the canister 2 is molded, and hence it is not necessary to especially produce another member such as the partition plate 139, and it is possible to reduce the number of steps and time required for component production and assembly.

Similarly to the configurations shown in FIGS. 4 and 5, a plurality of the holes 23 may be provided, and a pipe, a rib, and a sound absorbing member, and so on may be provided on the partition wall 24.

In addition, also in the case where the air pump 12 shown in FIG. 7 is mounted to a different component other than the canister 2, the air pump 12 may be appripriately mounted after the configuration corresponding to the partition plate 139 and the hole 138 in Embodiment 1 is formed in that different component.

Note that it is possible to freely combine the embodiments, modify any components of the embodiments, or omit any components in the embodiments within the scope of the invention of the present application.

Moreover, though the description has been made based on the assumption that the air pump 12 pressurizes the inside of the piping system 6 during the leak diagnosis, the leak diagnosis may be performed by depressurizing the inside of the piping system 6 with the air pump 12.

For example, in the case of the air pump 12 shown in FIG. 2, the intake opening portion 129 is communicated with the air side and the exhaust opening portion 137 separated by the partition plate 139 is communicated with the piping system 6, whereby the air (gas) is discharged and the inside of the piping system 6 is pressurized. In the case of the depressurization, the intake opening portion 129 is communicated with the piping system 6 and the exhaust opening portion 137 separated by the partition plate 139 is communicated with the air side, and the gas in the piping system 6 (e.g., gas in the canister 2) may be appropriately sucked.

Further, the air pump 12 may also be, e.g., a turbine-type air one other than the vane-type one, and the check valve 121 may also be, e.g., a spherical ball valve other than the umbrella-shaped one.

INDUSTRIAL APPLICABILITY

As described above, since the air pump according to the invention is capable of reducing the noise generated from the check valve during driving, the air pump is suitably used as a component of an air pump-type leak diagnosis apparatus.

DESCRIPTION OF REFERENCE NUMERALS AND SIGNS

1: fuel tank
2: canister
3: inlet manifold
4: purge solenoid valve
5: filter
6: piping system
11: electromagnetic valve
12: air pump
13: pressure gauge
14: temperature gauge
15: module
16: case
21: insertion opening
22: opening portion
23: hole
24: partition wall (partition plate)
110: coil
111: core
112: plunger
113: rod
114: valve seat
115: first opening portion
116: second opening portion
117: third opening portion
118: housing
119: valve body
120: spring
121: check valve
122: vane
123: rotor
124: first housing
125: metal plate
126: motor
127: connector
128: case
129: intake opening portion
130: filter
131: second housing
132: third housing
133: opening portion
134: partition wall
135: opening portion
136: filter
137: exhaust opening portion
138: hole
139: partition plate
140, 141: O-ring
142: pipe
143: sound absorbing member
144: rib
145: filter
161: first port
162: second port
163: wall (partition plate)
164: hole

The invention claimed is:

1. An air pump changing, for a leak diagnosis, an internal pressure of an evaporated fuel processing system that collects evaporated fuel generated in a fuel tank to introduce the collected evaporated fuel into an engine, comprising:

a housing provided with an opening portion communicating with the evaporated fuel processing system and an opening portion communicating with an air side;

a check valve disposed between the two opening portions of the housing to prevent a backflow of discharged gas; and a partition plate in which a hole serving as a first reducing part is opened and which is disposed at the opening portion from which the gas is discharged out of the two opening portions of the housing, to separate an inside from an outside of the housing, wherein a pipe in which a hole is formed is protrusively provided in the partition plate, and the pipe is extended toward the check valve to constitute a second reducing part with the pipe and the check valve.

2. The air pump according to claim 1, wherein the hole opened in the partition plate has an opening area that generates a pressure difference between the inside and the outside of the housing with the partition plate serving as a boundary.

3. The air pump according to claim 1, wherein a rib is protrusively provided on a surface of the partition plate that faces the check valve.

4. The air pump according to claim 1, wherein a sound absorbing member is provided on a surface of the partition plate that faces the check valve.

5. A module comprising:

an electromagnetic valve that opens and closes a flow path connecting an air side and an evaporated fuel processing system that collects evaporated fuel generated in a fuel tank to introduce the collected evaporated fuel into an engine;

an air pump that changes an internal pressure of the evaporated fuel processing system for a leak diagnosis; and a case that contains the electromagnetic valve and the air pump, wherein the air pump has a housing provided with an opening portion communicating with the evaporated fuel processing system and an opening portion communicating with the air side, and a check valve disposed between the two opening portions of the housing to prevents a backflow of discharged gas, and one surface of the case is a partition plate in which a hole serving as a first reducing part is formed and which faces the opening portion from which the gas is discharged out of the two opening portions provided in the housing of the air pump, to separate an inside from an outside of the housing, wherein a pipe in which a hole is formed is protrusively provided in the partition plate, and the pipe is extended toward the check valve to constitute a second reducing part with the pipe and the check valve.

6. An evaporated fuel processing system that collects evaporated fuel generated in a fuel tank to introduce the collected evaporated fuel into an engine, comprising:

an air pump that changes an internal pressure of the evaporated fuel processing system for a leak diagnosis; and an insertion opening into which the air pump is inserted, wherein the air pump has a housing provided with an opening portion communicating with the inside of the evaporated fuel processing system and an opening portion communicating with an air side, and a check valve disposed between the two opening portions of the housing to prevent a backflow of discharged gas, and the insertion opening has a partition plate in which a hole serving as a first reducing part is opened and which faces the opening portion from which the gas is discharged out of the two opening portions provided in the housing of the air pump, to separate an inside from an outside of the housing, wherein a pipe in which a hole is formed is protrusively provided in the partition plate, and the pipe is extended toward the check valve to constitute a second reducing part with the pipe and the check valve.

* * * * *